US007106014B1

(12) United States Patent
Mastalir et al.

(10) Patent No.: US 7,106,014 B1
(45) Date of Patent: Sep. 12, 2006

(54) LECTERN

(75) Inventors: Michael J. Mastalir, Green Bay, WI (US); Lon D. Seidl, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 10/820,075

(22) Filed: Apr. 7, 2004

Related U.S. Application Data

(60) Provisional application No. 60/460,944, filed on Apr. 7, 2003.

(51) Int. Cl.
*H02P 1/00* (2006.01)
*G06F 1/16* (2006.01)

(52) U.S. Cl. ..... 318/280; 318/283; D6/419; D6/511; 221/155; 108/44; 312/223.3; 361/683

(58) Field of Classification Search ..... 318/289, 318/283; D6/419, 511; 221/155; 108/44, 108/147; 312/223.3; 361/683
See application file for complete search history.

(56) References Cited

U.S. PATENT DOCUMENTS 2,291,931 A * 8/1942 Troeger ..... 353/78
2,388,353 A * 11/1945 Watson ..... 312/223.5
2,830,118 A * 4/1958 Kohler ..... 381/76
2,904,378 A * 9/1959 Maciver ..... 108/25
2,922,685 A * 1/1960 Lappin et al. ..... 108/146
3,023,274 A * 2/1962 Shaw ..... 381/75
3,443,031 A * 5/1969 Bolick, Jr. ..... 381/75
3,524,703 A * 8/1970 Wright ..... 353/35
3,745,291 A * 7/1973 Peterson et al. ..... 219/748
3,806,220 A * 4/1974 Payne ..... 312/330.1
3,832,001 A * 8/1974 Robinson ..... 312/235.2
3,936,109 A * 2/1976 Richardson ..... 312/223.5
3,963,096 A * 6/1976 Jones ..... 182/15
3,972,603 A * 8/1976 Lubinec ..... 40/457
4,065,194 A * 12/1977 Mattia ..... 312/247
4,101,005 A * 7/1978 Fewkes ..... 187/275
4,166,926 A * 9/1979 Sieler ..... 381/75
4,190,303 A * 2/1980 Ellis ..... 312/33
4,349,713 A * 9/1982 Marsen ..... 219/739
4,365,561 A * 12/1982 Tellier et al. ..... 108/7
4,440,096 A * 4/1984 Rice et al. ..... 108/3
4,550,666 A * 11/1985 Svoboda ..... 108/96
4,593,874 A * 6/1986 Dunagan ..... 248/188.4
4,604,956 A * 8/1986 Grebel et al. ..... 108/147
4,619,208 A * 10/1986 Kurrasch ..... 108/147
4,711,184 A * 12/1987 Wallin et al. ..... 108/147

(Continued)

FOREIGN PATENT DOCUMENTS

CN 1337199 A * 2/2002

(Continued)

*Primary Examiner*—Paul Ip
(74) *Attorney, Agent, or Firm*—Boyle, Fredrickson, Newholm, Stein & Gratz, S.C.

(57) ABSTRACT

A lectern incorporating a support member having a recess that can receive a control panel or laptop or notebook computer, for use with the by a speaker or other presenter. The support member defines an interior, and includes a keyboard tray slidably received within the interior and connectable to the monitor or computer positioned within the recess such that an individual can enter information directly from the keyboard into the device positioned within the recess. The lectern also includes a pair of sliding panels that can be used to cover or expose the device positioned within the recess. The lectern further includes a vertical adjustment mechanism for raising or lowering the height of the lectern as necessary.

21 Claims, 5 Drawing Sheets

U.S. PATENT DOCUMENTS

D296,851 S 7/1988 Kelley
4,784,382 A * 11/1988 Myers ..... 248/460
4,850,563 A * 7/1989 Grout ..... 248/422
4,856,741 A * 8/1989 Schaefer ..... 248/122.1
4,893,711 A * 1/1990 Gustafson ..... 206/45.24
5,074,221 A * 12/1991 Lochridge ..... 108/6
5,087,010 A * 2/1992 Walters ..... 248/455
5,088,421 A * 2/1992 Beckstead ..... 108/147
5,101,736 A * 4/1992 Bommarito et al. ..... 108/7
5,108,165 A * 4/1992 Rorke et al. ..... 312/322
5,124,887 A * 6/1992 Kobayashi ..... 361/685
D330,294 S 10/1992 Carr
D339,933 S 10/1993 Fafoutis
5,282,593 A * 2/1994 Fast ..... 248/188.4
5,285,733 A * 2/1994 Waibel ..... 108/147.19
5,322,025 A * 6/1994 Sherman et al. ..... 108/147
5,337,678 A * 8/1994 Grout ..... 108/147
5,437,235 A * 8/1995 Randolph ..... 108/25
D365,223 S 12/1995 Pryor
5,480,119 A * 1/1996 Fish et al. ..... 248/460
5,490,466 A * 2/1996 Diffrient ..... 108/96
5,615,620 A * 4/1997 Owen ..... 108/45
5,644,201 A * 7/1997 Jepsen et al. ..... 318/283
5,669,314 A * 9/1997 Grant ..... 108/48
5,685,510 A * 11/1997 Frankish ..... 248/188.4
5,697,686 A 12/1997 Miller et al.
D389,664 S 1/1998 Kotkosky
5,704,298 A * 1/1998 Corpuz et al. ..... 108/50.01
5,752,448 A * 5/1998 Eyre ..... 108/20
5,806,943 A 9/1998 Dell et al.
D401,774 S 12/1998 Burke et al.
D402,824 S 12/1998 Gareau et al.
5,883,200 A * 3/1999 Tsuchiya et al. ..... 525/517
5,906,420 A * 5/1999 Rozier et al. ..... 312/223.6
5,913,582 A 6/1999 Coonan
5,927,213 A * 7/1999 Leday ..... 108/96
6,012,788 A * 1/2000 Marschand et al. ..... 312/223.3
6,029,587 A * 2/2000 Rozier et al. ..... 108/147.21
6,062,148 A * 5/2000 Hodge et al. ..... 108/147
6,086,173 A 7/2000 Restell
6,119,605 A * 9/2000 Agee ..... 108/147
6,234,085 B1 * 5/2001 Ramundo ..... 108/43
6,241,329 B1 * 6/2001 Nielsen ..... 312/107
6,247,772 B1 * 6/2001 Tuttle et al. ..... 312/317.3
6,257,531 B1 * 7/2001 Penner ..... 248/118
6,269,753 B1 * 8/2001 Roddan ..... 108/50.01
6,286,440 B1 * 9/2001 Jyringi ..... 108/50.01
6,286,441 B1 * 9/2001 Burdi et al. ..... 108/147
6,296,215 B1 * 10/2001 McCoy et al. ..... 248/284.1
6,311,944 B1 * 11/2001 McKsymick et al. ..... 248/461
D451,301 S 12/2001 Abboud et al.
6,344,970 B1 * 2/2002 Geitz ..... 361/687
6,370,021 B1 * 4/2002 Hinzpeter et al. ..... 361/683
6,412,427 B1 * 7/2002 Merkt ..... 108/147
6,446,564 B1 * 9/2002 Anderson ..... 108/71
6,454,064 B1 * 9/2002 Cheng ..... 190/11
6,470,809 B1 * 10/2002 Herbert ..... 108/44
6,474,243 B1 * 11/2002 Grohse ..... 108/10
6,523,716 B1 * 2/2003 Goldberg et al. ..... 221/155
6,546,880 B1 * 4/2003 Agee ..... 108/147
6,571,720 B1 * 6/2003 Moore ..... 108/147
6,595,144 B1 * 7/2003 Doyle ..... 108/147
D482,900 S * 12/2003 DeJule et al. ..... D6/419
D492,863 S * 7/2004 DeJule et al. ..... D6/511
6,883,439 B1 * 4/2005 Moore ..... 108/147
2001/0015567 A1 * 8/2001 Tholkes et al. ..... 297/172
2001/0037751 A1 * 11/2001 Agee ..... 108/147
2001/0054619 A1 * 12/2001 Goldberg et al. ..... 221/155
2002/0020329 A1 * 2/2002 Kowalski ..... 108/50.01
2002/0063072 A1 * 5/2002 Pham ..... 206/320
2002/0089203 A1 * 7/2002 Flowerday et al. ..... 296/37.8

FOREIGN PATENT DOCUMENTS

DE 3241409 A1 * 5/1983
DE 4130310 A1 * 3/1993
DE 29907619 U1 * 7/1999
DE 19822121 A1 * 11/1999
DE 10047284 A1 * 4/2002
DE 20313535 U1 * 11/2003
DE 20318838 U1 * 5/2004
EP 1252838 A1 * 10/2002
FR 2490085 A * 3/1982
FR 2791534 A1 * 10/2000
GB 2186385 A * 8/1987

* cited by examiner 70
66
68
54
64
60
62
24
78
10
78
14
81
82
82
81
23
46
43
K
43
28
16
27
15
13
30
11
83
S 9
66
60
70
64
10
62
78
78
K
14
46
48
50
47
47
43
41
42
43
45
40
28
27
13
30
11
12
12
S
9

66
60
24
10
14
23
48
43
16
15
28
13
26
30
S
12
12

LECTERN

CROSS-REFERENCE TO RELATED APPLICATION

This application claims the benefit of U.S. Provisional Application Ser. No. 60/460,944, filed Apr. 7, 2003.

FIELD OF THE INVENTION

The present invention relates to furniture, and more specifically to a lectern for use in auditoriums and other speaking venues.

BACKGROUND OF THE INVENTION

A speaking venue is often provided with a lectern or podium, in order to provide a surface for any papers or notes used by the speaker as well as to provide a structure to support a microphone and to house voice amplification components and/or controls. Prior art lecterns or podiums are normally constructed of a base supported on a floor or other supporting surface, a frame or column extending upwardly from the base, and a support member disposed on an upper end of the column opposite the base. The speaker is able to rest or lean against the support member while speaking, and may also place any notes or papers on an upwardly facing support surface defined by the support member.

Prior art lecterns are typically constructed such that the support surface is fixed at a specific height without being adjustable to accommodate speakers of differing stature. Also, prior art lecterns have significant shortcomings when the speaker uses an electronic device such as a computer for assistance in a speech or presentation. While prior art lecterns are able to support the device on the surface, such lecterns have no provisions for accommodating wires or cables associated with the device, which results in such wires or cables trailing off of the surface and down the sides or back of the lectern.

Therefore, it is desirable to develop a lectern that is adjustable in height to adapt to the height of a particular speaker using the lectern. It is also desirable to develop a lectern that facilitates use of a device, such as a computer, by the speaker. Furthermore, it is desirable to develop a lectern that includes the capability to transmit data from a device, such as a computer, to one or more various display devices connected to the lectern in order to more easily display data or information to the audience.

SUMMARY OF THE INVENTION

To address these shortcomings of the prior art, the present invention provides a lectern including a base, an adjustable, upright column connected to the base, and a support member connected to the column opposite the base that includes integral connections for providing power and communication capabilities to a device, such as a computer, that is used by the speaker.

The column of the lectern includes a vertical adjustment mechanism that enables the support member to be moved vertically in order to accommodate speakers of varying heights. The vertical adjustment mechanism can be automatically actuated by a control system that is disposed on the support member for easy actuation by the individual utilizing the lectern, to adjust the height of the column as necessary.

A support surface is formed as an upper part of the support member and includes a recess which is adapted to receive an electronic device, such as a touch screen electronic monitor or a laptop computer, which can be operably connected to the lectern. The lectern also includes a well associated with the support surface, which is preferably located toward the front of the support surface. The well is adapted to receive and store cords, communication cables or the like associated with the electronic device placed within the recess, to facilitate connection to the lectern and to enable transmission of power and data to and from the lectern, or to an ancillary display device.

The support member also includes an opening or cavity below the upper support surface. A keyboard tray is slidably positioned within the opening or cavity, such that a keyboard positioned on the tray can be selectively exposed from within the support member. When an electronic device is connected to the lectern, the keyboard is also connected to the device to enable an individual to manually key information into the touch screen or laptop computer for display on the ancillary display device that is connected to the lectern or otherwise interconnected with the electronic device.

Other additional features, alternatives and embodiments of the present invention will be made apparent from the following detailed description taken together with the drawings.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
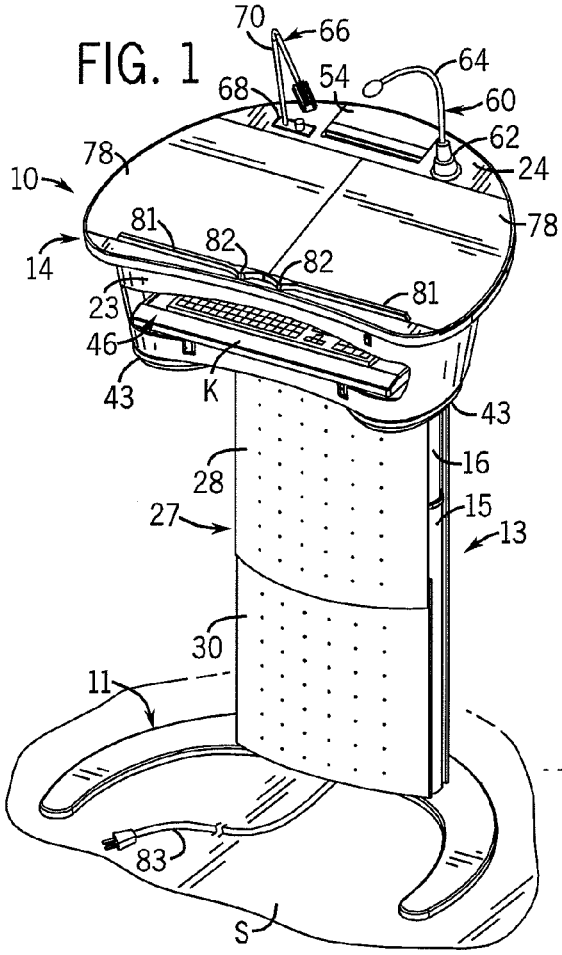
FIG. 1 is an isometric view of a lectern constructed according to the present invention.
Figure 2:
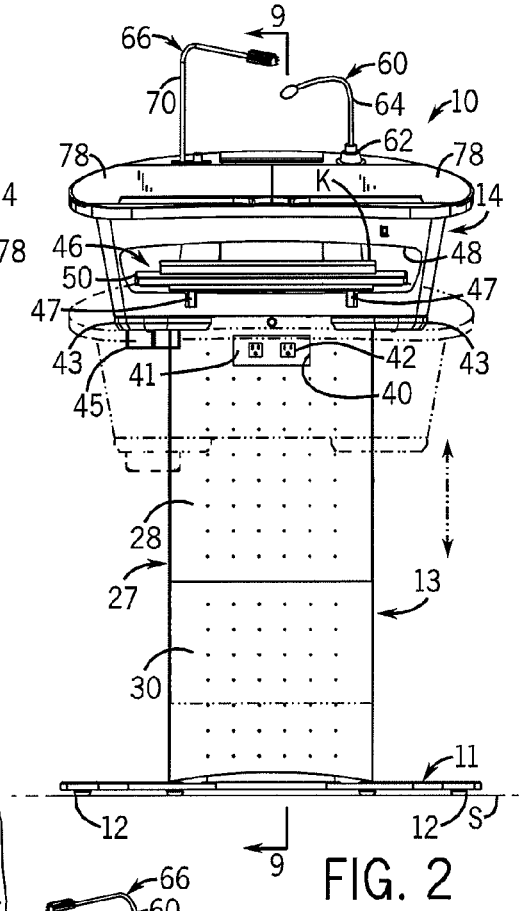
FIG. 2 is a rear elevation view of the lectern of FIG. 1.

Referring to the drawing figures in which like reference numerals designate like parts throughout the disclosure, a lectern constructed according to the present invention is indicated generally at 10. The lectern 10 includes a generally U-shaped base 11 having high-friction, surface-engaging feet 12 that contact or rest on a support surface S on which the lectern 10 is positioned, an upright support column 13 connected to the base 11 and extending upwardly therefrom, and a support member 14 attached to the support column 13 opposite the base plate 11.

Figure 3:
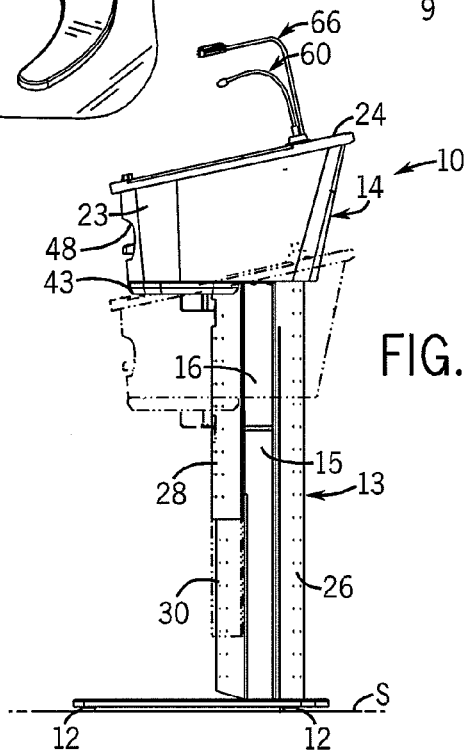
FIG. 3 is a side elevation view of the lectern of FIG. 1.
Figure 9:
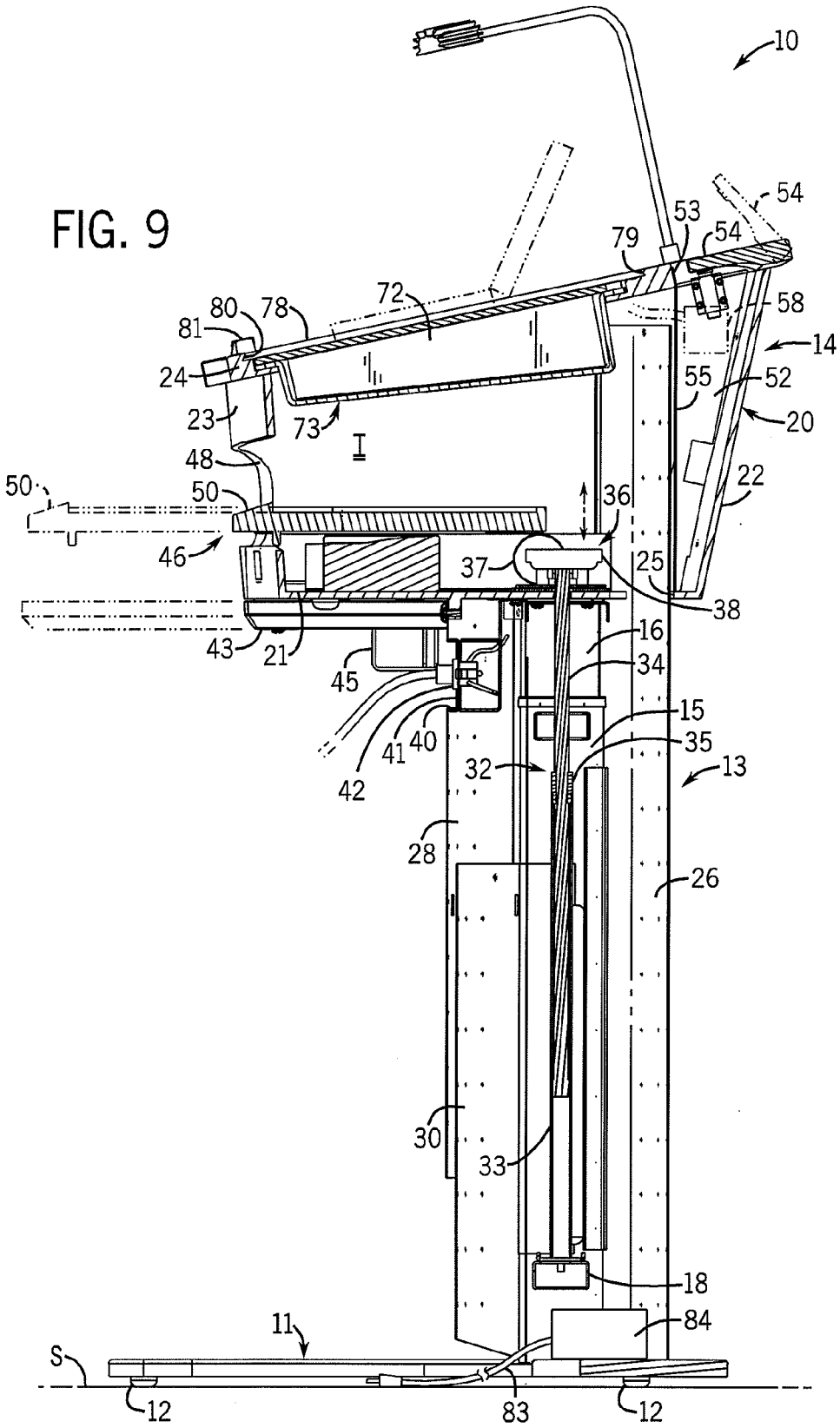
FIG. 9 is sectional view taken along line 9—9 of FIG. 2.

As shown in FIGS. 1, 3 and 9, the upper ends of inner legs 16 are connected to the support member 14. The support member 14 is formed of a head shroud 20 that includes an interior I defined by a bottom wall 21 connected to the inner legs 16, a convex front wall 22, a concave rear wall 23, and a sloped upper support wall 24 joining the concave rear wall 23 with the convex front wall 22. The bottom wall 21 includes an opening 25 positioned forwardly of the inner legs 16 that receives one end of a front shroud 26 forming a part of column 13. The front shroud 26 extends into interior I of head shroud 20 from the opening 25 of the base plate 11, and is secured to the outer legs 15 to provide a seamless appearance to the front of the column 13. Opposite the front shroud 26, the column 13 also includes a rear shroud 27 including an upper portion 28 and a lower portion 30. The lower portion 30 extends upwardly from the base plate 11 and is attached to the outer legs 15 opposite the front shroud 26, while the upper portion 28 extends downwardly from the bottom wall 21 of the head shroud 20 and moves along with the head shroud 20.

Figure 5:
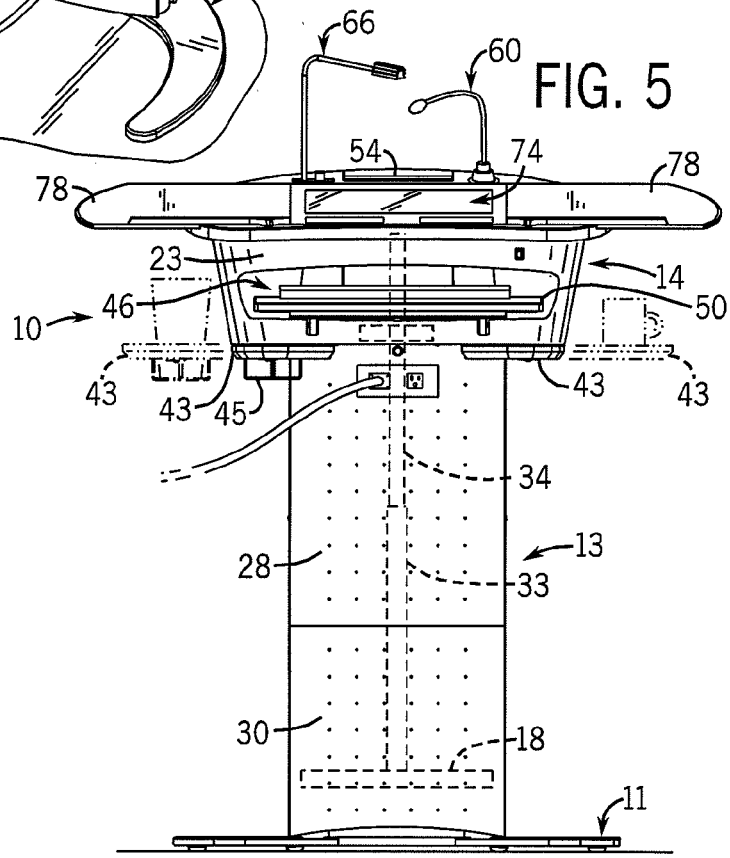
FIG. 5 is a rear elevation view of the lectern of the present invention as illustrated in FIG. 4.

Referring to FIGS. 5 and 9, an extendible and retractable assembly, such as a screw-type linear actuator 32, is located in the column 13 between the front shroud 26 and rear shroud 27 in order to enable the support member 14 to move vertically with respect to the base plate 11. The linear actuator 32 includes a lower tube 33 connected to the cross member 18 and extending upwardly therefrom. Linear actuator 32 further includes a lead screw 34 that is engaged with a lead nut 35 mounted to the upper end of lower tube 33. An actuator in the form of a motor-operated drive 36 is mounted to lower wall 21 in the interior of head shroud 20. Drive 36 includes a motor 37 that provides input power to a gear head 38, which in turn is engaged with the upper end of lead screw 34. With this arrangement, gear head 38 imparts rotation to lead screw 34 in response to operation of motor 37. Such rotation of lead screw 34 causes head shroud support member 14 to be moved vertically upwardly or downwardly relative to support column 13 according to user requirements, depending on the direction of rotation of lead screw 34. While the motor 36 is shown and described as being directly interconnected with lead screw 34 through gear head 37, it is also understood that any other satisfactory drive arrangement may be employed, such as a chain and sprocket arrangement, a belt drive or a gear drive arrangement. It is also understood that any other satisfactory type of lifting and lowering arrangement may be employed in place of linear actuator 32, e.g. a pneumatic or hydraulic cylinder arrangement or the like.

During vertical adjustment of support member 14 as described, support member 14 moves upwardly and downwardly relative to front shroud 26, the upper end of which is received within interior I of head shroud 20. In this manner the seamless, aesthetically pleasing appearance provided by the front shroud 26 is maintained when the support member 14 moves upwardly, by the length of the front shroud 26 that extends through the opening 25 into the interior I of the head shroud 20 and is exposed when the support member 14 moves upwardly. Furthermore, the rear shroud 27 also maintains complete coverage of the rear of the column 13 because the upper portion 28 of the rear shroud 27 moves upwardly and downwardly along with the support member 14 with respect to the lower portion 30 in a telescoping manner, in order to maintain the generally continuous appearance of the rear shroud 27.

In order to supply power from the lectern 10 to an area adjacent support member 14, the upper portion 28 of the rear shroud 27 includes an opening 40 in which is disposed a power brick 41 including a pair of electric power outlets 42. The power brick 41 and outlets 42 move in conjunction with the upper portion 28 of the rear shroud 27 during adjustment in the height of support member 14 as described above, in order to maintain the distance between the outlets 42 and the support member 14 if the cords from devices positioned on the support member 14 are connected to the outlets 40. Outlets 40 are adapted to supply power to any ancillary equipment that may be employed by the user of lectern 10, such as a projector or the like.

In order to further accommodate an individual using the lectern 10, the support member 14 also includes a pair of pivotable retractable supports, in the form of drink holders 43 secured to the support member 14. Each drink holder 43 is pivotally connected to the bottom wall 21 of the head shroud 20 opposite the front wall 22, and includes a recess 44 in which a cup or other beverage container may be positioned. The recess 44 can be formed as a wire cage, shown at 45, which extends through and downwardly from the drink holder 43, or may be simply a depression in the upper surface of drink holder 43 or an opening formed in the drink holder 43. While the pivoting retractable supports are described as drink holders, it is understood that a support that simply includes a depression, as opposed to an opening, may be used not only to support a beverage container but also any other items such as a user's keys, change, laser pointer, etc.

The support member 14 also includes a keyboard support assembly 46 disposed within the interior I of support member 14. The keyboard support assembly 46 includes a pair of tracks 47 disposed on either side of head shroud interior I. An elongate opening 48 is formed in the rear wall 23 of the head shroud 20, and is in communication with head shroud interior I. The tracks 46 slidably receive a keyboard support tray 50 therein, which can be moved into and out of the head shroud interior I through slot 48 in the rear wall 23, between a retracted position as shown in solid lines in FIG. 9 and an extended position as shown in phantom in FIG. 9. The support tray 50 is configured to support a keyboard K, which can be connected to an electronic device positioned on the upper wall 24 of the support member 14. In the retracted position, the support tray 50 is located within the interior I of head shroud 20. Preferably, the support tray 50 is configured such that the rear edge of support tray 50 and the rear portion of keyboard K are exposed, to provide a visual cue to the user and also to provide easy access to support tray 50 and keyboard K. In the extended position, the support tray 50 is moved outwardly so that keyboard K is accessible to a user of lectern 10. In this manner, the user is able to input information directly to the electronic device, such as a laptop or notebook computer, that is utilized with the lectern 10, in order to enable the user to manipulate data or programs used in connection with a presentation, or to access the internet or a local are network, or to accomplish any other task normally associated with a computer or other similar type of electronic device. Typically, keyboard K is interconnected with a presentation controller, commonly available under the designation CRESTRON®, which controls all aspects of a presentation environment, e.g. lights, projectors, projection screens, room temperature, remote cameras, etc. In the event keyboard K is not required, the user is able to move support tray 50 to the retracted position, so that support tray 50 does not interfere with use of lectern 10. Support tray 50 may also be configured to include a mouse pad that can be positioned to either side of the keyboard K, to accommodate a computer mouse in a position that is convenient for a user.

In the event a keyboard is not used or desired, tray 50 and tracks 46 are eliminated and slot 48 in the rear wall 23 of shroud 20 is enclosed by a snap-in cover.

In order to effectively collect and conceal the wires (not shown) utilized to connect the various parts of the lectern 10 with the electronic device or devices positioned on the lectern 10, the support member 14 also includes a well 52 (FIG. 9) located below the upper wall 24 of the head shroud 20 adjacent the front wall 22. The well 52 extends downwardly within the head shroud 20 to the bottom wall 21, and an opening 53 is formed in upper wall 24 to provide access to well 52. The well 52 is enclosed by a cover 54 pivotally secured to the upper wall 24 that is biased to an open position and can be maintained in a closed position by a magnetic latch 56 releasably engageable with the cover 54. Cover 54 is configured to enclose the majority of the area of opening 53, and defines a rear edge spaced from the front edge of opening 53 so as to form an open slot the provides access to well 52. With this construction, wires or cables from devices supported on support member 14 pass through the open slot defined by cover 54 into well 52. A partition wall 55 is located in head shroud interior I, and cooperates with front wall 22 of head shroud 14 to define well 52.

A power brick 58 is located in well 52, and includes power receptacles for connection electronic devices supported on support member 14. Well 52 also may include one end of a data cable that is routed from base 11 through column 13, and which is interconnected with a LAN or other network. The user can then pull the data cable out of well 52 and connect it to the user's computer or other electronic device, for interconnection with a network.

Immediately adjacent the well 52, the support member 14 further includes a microphone 60 and a light 66 mounted to upper wall 24. The microphone 60 is operably connected to a conventional amplification system (not shown) and includes a base 62 connected to the upper wall 24 and a flexible stem 64 which enables a user of the lectern 10 to position the microphone 60 where desired. Similarly, the light 66 includes a base 68 connected to the upper wall 24 and a flexible stem 70 that allows the light to be positioned in a manner similar to the microphone 60.

As shown in FIG. 9, the support member 14 also includes a recess 72 disposed on the upper wall 24 between the front wall 22 and rear wall 23. In the illustrated embodiment, recess 72 is formed by a pan member 73 that is secured within an opening formed in upper wall 24, e.g. by means of a peripheral flange secured to a peripheral lip defined by upper wall 24, although it is understood that any other satisfactory construction and mounting arrangement may be employed. Recess 72 is dimensioned to receive an electronic device, such as a control panel or flat screen monitor 74 (FIGS. 1, 7), which is positioned within recess 72 such that the surface of monitor 74 is flush with the upper wall 24 of support member 14. Alternatively, recess 72 may be used to receive a laptop or notebook computer, and is configured such that the flip-up screen of the computer may be opened when the computer is positioned within recess 72. The monitor 74 or the user's computer can also be connected to the power brick 58 disposed within the well 52, in order to receive power from the lectern 10 and to provide an interface with a network or the internet. Power brick 58 also provides an interface between the user's computer or a network with a display device (not shown), such as a projector or the like. In situations where a laptop or notebook computer is positioned within the recess 72, the connections between the computer and the power brick 58 can be easily made and disconnected in order to allow the computer to be quickly and easily positioned within and removed from the recess 72 as necessary.

Figure 8:
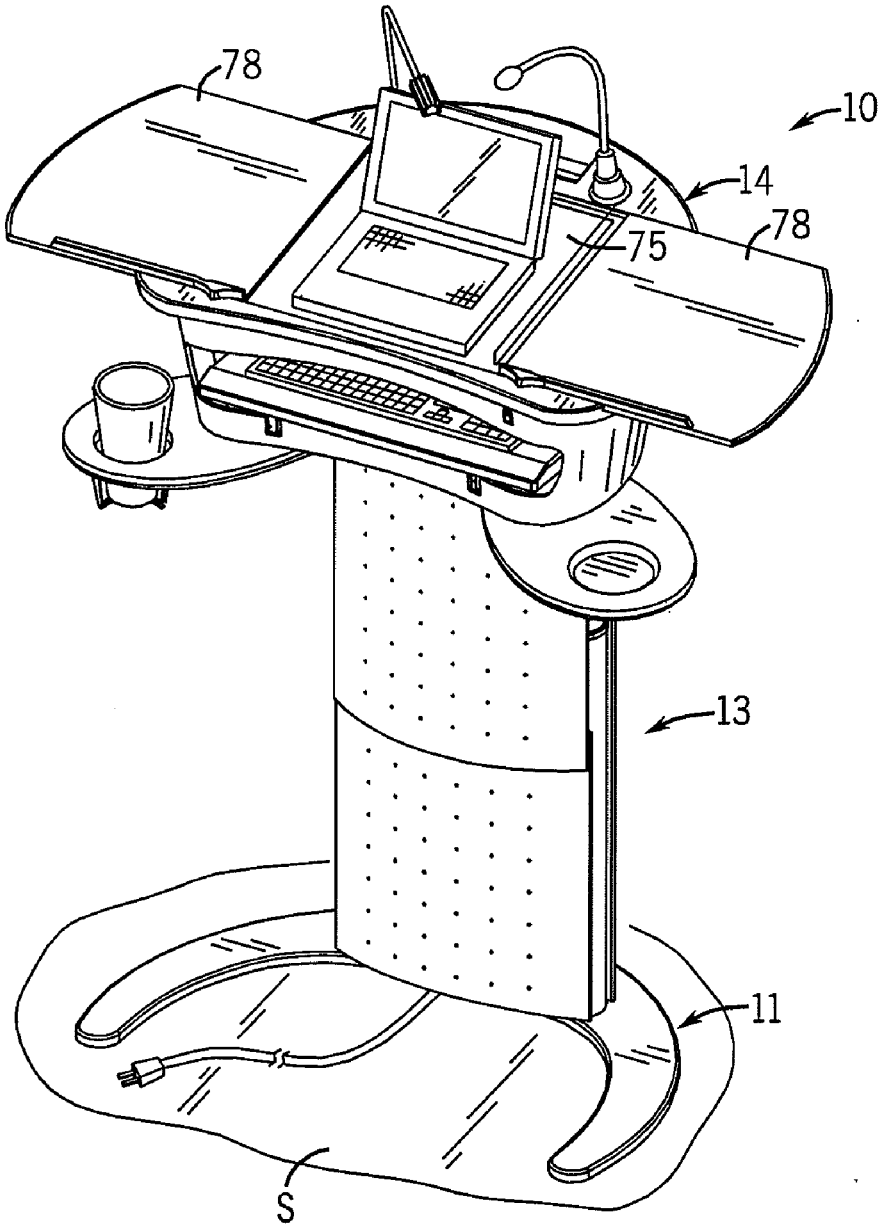
FIG. 8 is an isometric view similar to FIG. 1, showing use of a laptop computer in connection with the lectern of the present invention.

Alternatively, as shown in FIG. 8, recess 72 may be closed by a top panel 75 that provides an upper surface adapted to support a user's laptop or notebook computer.

Monitor 74 may be a touchscreen-type monitor used to control presentation technology. In addition, monitor 74 may be interconnected with a control arrangement for the room environment in order to control room lighting, sound, temperature, etc.

Figure 4:
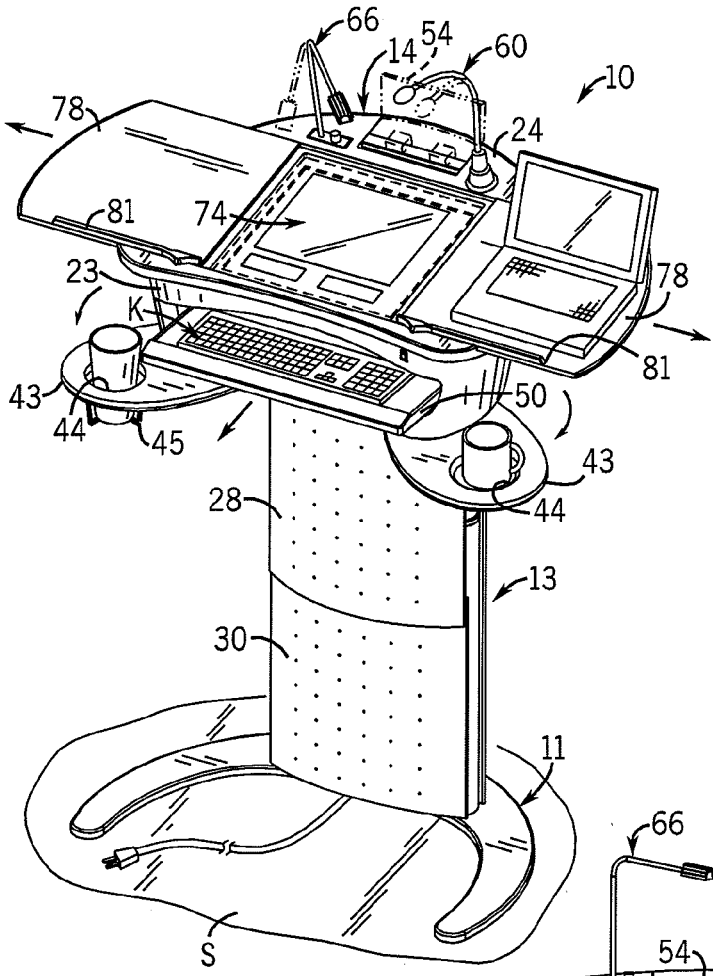
FIG. 4 is a an isometric view similar to FIG. 1, showing various features incorporated into the lectern of the present invention
Figure 6:
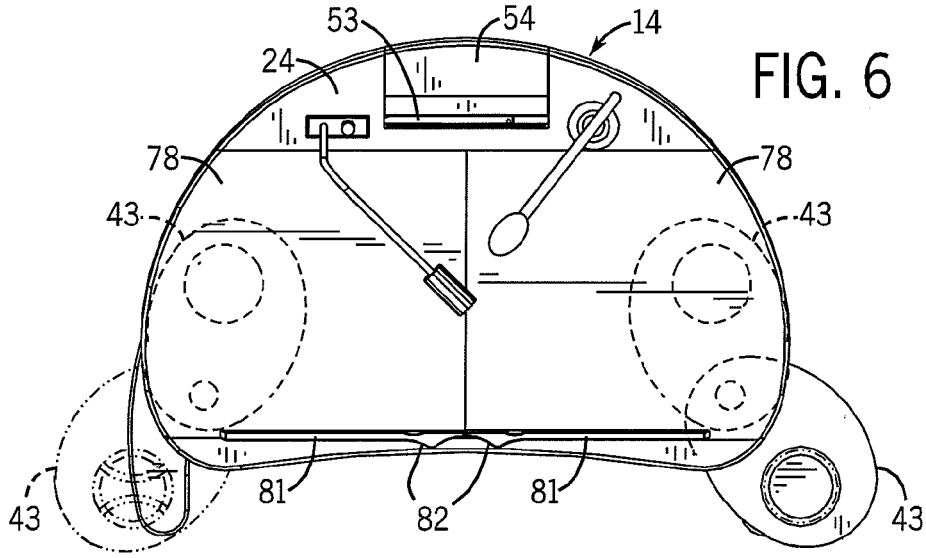
FIG. 6 is a top plan view of the lectern of the present invention as illustrated in FIG. 1.
Figure 7:
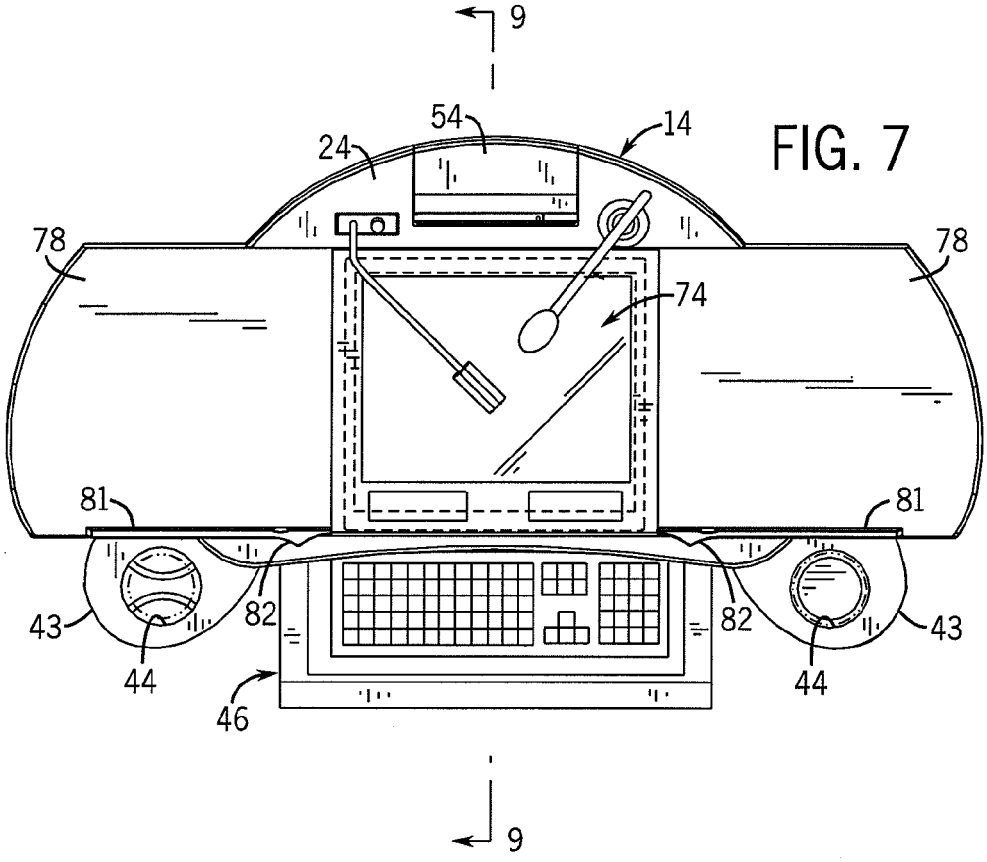
FIG. 7 is a top plan view of the lectern of the present invention as illustrated in FIG. 4.

The support member 14 also includes a pair of slidable panels 78 connected to opposite sides of the upper support wall 24. The panels 78 are slidably received within a transverse recess in the upper surface of upper support wall 24, which overlies recess 72 formed by pan member 73. The transverse recess is defined by a parallel beveled front and rear edges 79, 80, respectively, which extend throughout the width of upper wall 24. Panels 78 have beveled front and rear edges that are configured so as to be complementary with beveled front and rear edges 79, 80, respectively, of upper wall 24. With this construction, panels 78 are captured within the recess in upper wall 24, and are capable of sliding movement relative to upper wall 24 between a closed position as shown in FIGS. 1 and 6, and an open position as shown in FIGS. 4 and 7. Each panel 78 has a support ledge 81 that extends upwardly from its upper surface, for use in supporting papers or the like that rest on the panel upper surface. Each support ledge 78 includes an engagement section 82 at its inner end, which is shaped to facilitate engagement by a user's fingers to slide panels 78 between the closed and open positions. In this manner, the user can quickly and easily move panels 78 between the closed and open positions, to selectively cover and uncover the recess 72. When the recess 72 is covered, the panels 78 form a continuous supporting surface for the support member 14. When panels 78 are moved apart to expose the recess 72, the panels 78 provide a supporting surface on either side of the recess 72 for the user's notes or other papers, while providing access to the monitor 74 or computer positioned within recess 72. In addition, the user may position a laptop or notebook computer on one of panels 78 when panels 78 are in the open position, as shown in FIG. 4, which enables a user to take advantage of the computer as well as monitor 74. It can thus be appreciated that support member 14 can be selectively configured to provide a conventional lectern arrangement in which panels 78 are closed to support notes or other papers, or to provide a combination configuration in which the user is able to utilize a computer and/or monitor 74 while still providing surface area for notes or other papers. This is not possible with conventional lecterns, wherein placement of a computer on the supporting surface of the lectern takes up substantially the entire supporting surface and does not leave space for notes or other papers.

In order to supply power to the lectern 10 for the various components of the lectern 10 including power brick 41, power brick 58, linear actuator motor 37, microphone 60 and light 66, lectern 10 includes an electric cord 83 that is provides power to a box 84 (FIG. 9) located adjacent base 11 between front shroud 26 and lower section 30 of rear shroud 27. Appropriate electrical wiring extends from box 84 to the various powered components of lectern 10, and is concealed within support column 13 and support member 14. In addition, lectern 10 facilitates a data cable to provide communication capability, as well as to interconnect lectern 10 with the environmental controls for the room within which lectern 10 is contained. Alternatively, it is contemplated that lectern 10 may communicate data signals using an appropriate wireless network, in a manner as is known.

It should be understood that the various features of lectern 10 may be used separately from each other or in various subcombinations, and each such feature or subcombination provides advantages in construction and operation over a conventional lectern.

Various alternatives are contemplated as being within the scope of the following claims particularly pointing out and distinctly claiming the subject matter regarded as the invention.

We claim:

1. A lectern comprising:

a base adapted for engagement with a supporting surface;

a single central column assembly defining a lower end attached to the base and an upper end spaced above the lower end;

a support member attached to the upper end of the single central column assembly, wherein the single central column assembly is operable to position the support member above the supporting surface;

a height adjustment arrangement associated with the single central column assembly, wherein the height adjustment arrangement is operable to adjust the height of the single central column assembly, and wherein adjustment in the height of the single central column assembly is operable to adjust the vertical position of the support member relative to the supporting surface; and wherein the single central column assembly includes a fixed height member defining an upper end, and wherein the support member includes an interior into which the upper end of the fixed height member extends, wherein adjustment in the vertical position of the support member by operation of the height adjustment arrangement of the single central column assembly causes vertical relative movement between the upper end of the fixed height member and the support member within the interior of the support member.

2. The lectern of claim 1, wherein the height adjustment arrangement is disposed within in interior defined by the single central column assembly, wherein the height adjustment arrangement includes a stationary member interconnected with the base and an extendible and retractable member interconnected with the support member.

3. The lectern of claim 1, wherein the height adjustment arrangement comprises a linear actuator assembly, wherein the stationary member comprises a tubular member interconnected with the base and wherein the extendible and retractable member comprises a threaded member interconnected with the support member and engaged with a mating threaded member secured to the tubular member.

4. The lectern of claim 3, further comprising a motor carried by the support member, wherein the motor is drivingly engaged with the threaded member to impart rotation to the threaded member to selectively raise and lower the support member.

5. The lectern of claim 1, wherein the single central column assembly includes at least one telescoping leg member having a first section secured to the base and a second section secured to the support member.

6. The lectern of claim 5, wherein the single central column assembly further includes a cover arrangement configured to conceal the at least one telescoping leg.

7. The lectern of claim 1, wherein the support member includes an opening providing access to the interior of the support member, and further comprising a keyboard support member located within the interior of the support member and movable to an extended position through the opening to provide access to a keyboard supported by the keyboard support member.

8. The lectern of claim 1, wherein the support member includes an upper wall defining an upwardly facing recess, and further comprising a pair of panels engaged with the upper wall and movable between an open position providing access to the recess and a closed position preventing access to the recess.

9. The lectern of claim 1, wherein the support member includes an upper wall defining a support surface, and further comprising a well extending inwardly from the upper wall, wherein the well is configured to receive wires or cables associated with equipment adapted to be supported by the upper wall.

10. The lectern of claim 9, further comprising a power supply member located in the well for providing a power connection to the wires or cables received within the well.

11. The lectern of claim 1, wherein the fixed height member comprises a cover member forming a part of the single central column assembly that extends between the base and the upper end of the single central column assembly.

12. A lectern comprising:

a base;

a vertically movable column defining a lower end attached to the base and an upper end spaced above the lower end; and a support member attached to the upper end of the column and vertically movable with the column so as to adjust the elevation of the support member wherein the vertically movable column includes at least one telescoping leg member having a first section secured to the base and a second section secured to the support member, and further includes a cover arrangement configured to conceal the at least one telescoping leg, wherein the support member defines an interior, and wherein the cover arrangement includes a first, fixed length cover member that extends upwardly from the base and a second cover member defined by a pair of cover member sections, wherein an upper end defined by the first cover member is received within the interior of the support member such that support member moves relative to the upper end of the first cover member upon vertical adjustment of the column, and wherein the cover member sections of the second cover member collapse and extend relative to each other upon vertical adjustment of the column.

13. The lectern of claim 12, wherein the vertically movable column includes a pair of transversely spaced telescoping legs, and wherein the first cover member extends between the pair of legs on one side of the lectern and wherein the second cover member extends between the legs on an opposite side of the lectern.

14. The lectern of claim 12, wherein the support member includes an opening providing access to the interior of the support member, and further comprising a keyboard support located in the interior of the support member, wherein the keyboard support is movable between a retracted position within the interior of the support member and an extended position in which the keyboard support is moved outwardly of the interior of the support member.

15. A lectern comprising:

a base adapted for engagement with a supporting surface;

a column defining a lower end attached to the base, and an upper end spaced vertically above the lower end; and a support member attached to the upper end of the column, wherein the support member defines a front and a rear and includes an upwardly facing recess adapted to receive an upwardly facing computer monitor, and wherein the support member further defines an interior and includes a rearwardly facing opening that provides access to the interior, and wherein the support member further includes an extendable and retractable keyboard support adapted to support a computer keyboard, wherein the keyboard support is movable between a storage position in which the computer keyboard is positioned within the interior of the support member and an extended position in which the computer keyboard is moved outwardly through the rearwardly facing opening and is positioned rearwardly of the interior of the support member.

16. The lectern of claim 15, wherein the column includes a height adjustment arrangement for adjusting the height of the support member relative to the supporting surface.

17. The lectern of claim 15, wherein the support member includes an upper wall and wherein the upwardly facing recess extends inwardly from the upper wall, and further comprising a movable panel arrangement movably engaged with the upper wall for movement between a closed position in which the panels arrangement is positioned to overlie and enclose the recess and an open position in which the panels arrangement is positioned to expose the recess.

18. The lectern of claim 15, further comprising one or more power and communication connection members associated with the lectern for providing power and communication capability to a device supported by the support member.

19. The lectern of claim 18, wherein the support member includes a well located adjacent the recess for receiving one or more cables or wires extending from the electronic device, and wherein at least one of the power and communication connection members is located in the well.

20. A lectern, comprising:

a base;

an adjustable height column defining a lower end interconnected with the base and an upper end spaced above the lower end, wherein the adjustable height column includes a telescoping leg arrangement;

a support member defining an interior, wherein the support member is secured to the upper end of the adjustable height column;

an extendible and retractable actuator assembly interconnected between the base and the support member for adjusting the elevation of the support member relative to the base, wherein operation of the actuator assembly causes extension and retraction of the telescoping leg arrangement; and a cover arrangement including a first, fixed height cover section that extends upwardly from the base and into the interior of the support member, and a second, collapsible cover section that extends between the support member and the base.

21. The lectern of claim 20, wherein the telescoping leg arrangement includes a pair of transversely spaced telescoping legs, wherein the first cover section extends between the pair of legs on one side of the lectern and wherein the second cover section extends between the legs on the opposite side of the lectern.

* * * * *